United States Patent [19]

Menne et al.

[11] 4,301,735

[45] Nov. 24, 1981

[54] VIBRATION TRANSMISSION SYSTEM FOR IGNITION DEVICES

[75] Inventors: Rolf Menne, Cologne; Willi Petters, Leverkusen, both of Fed. Rep. of Germany

[73] Assignee: Dynamit Nobel Aktiengesellschaft, Troisdorf, Fed. Rep. of Germany

[21] Appl. No.: 72,751

[22] Filed: Sep. 5, 1979 (Under 37 CFR 1.47)

[30] Foreign Application Priority Data

Sep. 6, 1978 [DE] Fed. Rep. of Germany ..... 2838806

[51] Int. Cl.[3] ..... F42C 11/02; F42B 23/26

[52] U.S. Cl. ..... 102/427

[58] Field of Search ..... 102/19.2, 206, 210, 102/211, 215

[56] References Cited

U.S. PATENT DOCUMENTS 3,509,791 5/1970 Pechamat et al. ..... 102/19.2

4,112,844 9/1978 Held et al. ..... 102/19.2

*Primary Examiner*—Charles T. Jordan

*Attorney, Agent, or Firm*—Sprung, Felfe, Horn, Lynch & Kramer

[57] ABSTRACT

In a system for the transmission of ground vibrations to an ignition device, a frequency filter and a timing circuit are disposed between the sensor and the ignition device. The timing circuit permits the feeding of the output signal of the frequency filter to the ignition device only after the mechanical vibrations producing the output signal of the frequency filter have acted on the sensor for a predetermined, variable period of time.

6 Claims, 1 Drawing Figure

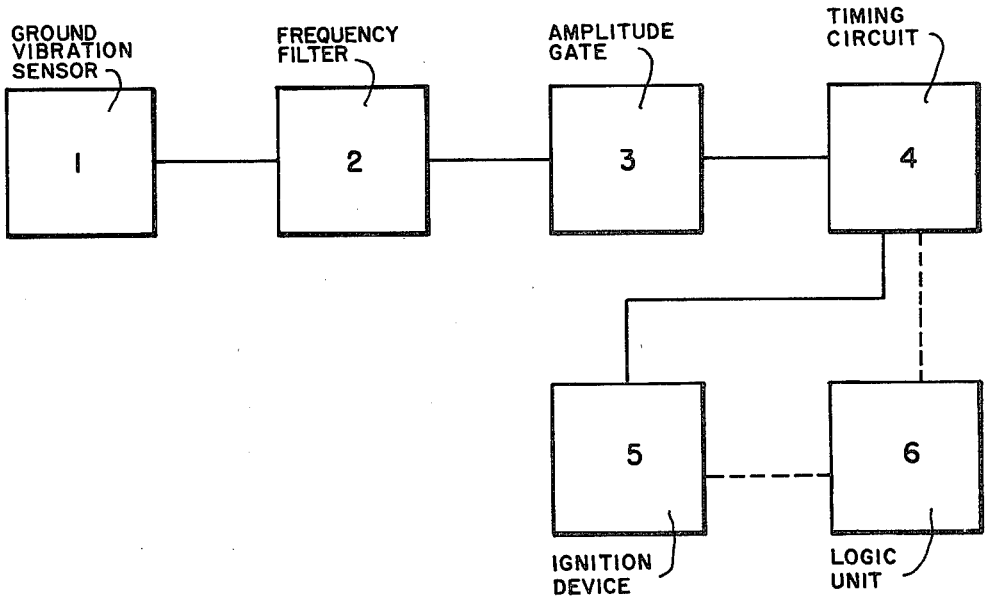
GROUND VIBRATION SENSOR
FREQUENCY FILTER
AMPLITUDE GATE
TIMING CIRCUIT
1
2
3
4
5
6
IGNITION DEVICE
LOGIC UNIT

VIBRATION TRANSMISSION SYSTEM FOR IGNITION DEVICES

BACKGROUND OF THE INVENTION

The present invention relates to a system for the transmission of ground vibrations to an ignition device, wherein the mechanical vibrations are picked up by a sensor and transmitted in the form of signals to the ignition device.

It is known in the art to set off mines and other approach surveillance systems with the aid of sensors which evaluate a change in or an anomaly of magnetic fields. However, these systems are readily fooled and therefore must at least be combined with other sensing devices.

Suited for such combination with magnetic field sensors, are known devices which sense ground vibrations such as those produced by vehicles or airplanes. The known sensors operate on different physical principles and sense the entire low-frequency spectrum of ground vibrations.

When such known devices are combined with systems which sense changes in magnetic fields, or when these known devices evaluating mechanical vibrations are used alone, the systems have the disadvantage that signals which are not supposed to trigger ignition, as, for example, signals emanating from a source which is too far away or which are also generated by interference to ground vibrations, reach the ignition device as well.

SUMMARY OF THE INVENTION

The object of the present invention is to eliminate the disadvantages of the prior art in the transmission of mechanical vibrations to an ignition device.

In accordance with the invention, this object is achieved by a system for the transmission of ground vibrations to an ignition device wherein the output signals of a sensor picking up mechanical vibrations are transmitted to the ignition device via means disposed between the sensor and the ignition device including a frequency filter and a timing circuit, the latter allowing the output signal of the frequency filter to be fed to the ignition device only when the vibrations producing the output signal have acted on the sensor for a predetermined, variable period of time.

The timing circuit evaluates the amplitude content of one or more vibrations in a predetermined unit of time. The timing circuit may therefore be a time integrator, known per se, so that the evaluation is upwardly integrated with the ground vibration. With this procedure it is advantageous to feed only signals above a preset amplitude threshold to the time integrator. For this reason, an amplitude gate or filter, known per se, is interposed ahead of the time integrator.

Such an amplitude gate may also be coupled to the frequency filter. It should be set so that only vibrations above a specific variable amplitude (the lower threshold) are passed. A limit should also be set on the maximum amplitude, since sudden undesirable strong ground vibrations as caused by detonations, for example, are then excluded from evaluation.

In accordance with the invention, the time evaluation by means of the timing circuit may also be effected digitally, by counting the vibrations or zero crossovers in which case the timing circuit is a time meter, which is known per se.

It is advantageous, moreover, to select the time evaluation so that target recognition is possible only after a time delay, reckoned from the first signal from the target object.

Time evaluation permits the exclusion from evaluation of ground vibrations which, though corresponding to a desired target object, may recognize it in an undesired position. It further permits the exclusion of signals produced by sudden or transient ground vibrations not due to vehicles.

The frequency filter which precedes the timing circuit is intended to pass only vibrations of a frequency range that is typical for ground vibrations induced by vehicles, and particularly tracked vehicles. Such frequency filters, too, are known per se.

The frequency filter may also be connected in parallel with the timing circuit. In that case the output signals of the timing circuit and of the frequency filter need only be applied to a logic unit before they are fed to the ignition device or to a further logic unit.

BRIEF DESCRIPTION OF THE DRAWING

The Figure is a schematic block diagram of the system according to the invention.

DETAILED DESCRIPTION OF THE INVENTION

Referring now to the Figure, the system and its principle of operation in accordance with the invention will be explained. A ground-vibration sensor 1 evaluates the frequency range which is typical for ground vibrations due to vehicles. These signals characteristic of vehicles are tested in a frequency filter 2 for their frequency, and, in addition, in an amplitude gate 3 primarily for their amplitude. Thus the signals applied to a timing circuit 4 for time integration are preferably signals between a minimum amplitude (lower threshold) and a maximum amplitude (upper threshold) and within a particular frequency slot. When a predetermined number of ground-vibration signals within the selected frequency range has been sensed in a defined period of time and a predetermined number of signals has been upwardly integrated or counted in the timing circuit 4, then that information is fed as a target recognition either to a succeeding logic unit 6 or directly to an ignition device 5. When a logic unit 6 is interposed, it is used to logically combine the signals with information from other sensors, for example, those for the evaluation of magnetic field changes as mentioned heretofore.

When the number of signals necessary for target recognition is not attained within the time and amplitude slot, then those signals are cancelled or downwardly integrated. This may be done by resetting the timing circuit 4 to zero condition or a steady state condition after a predetermined time, or also by downward integration. The time response of the downward integration may differ from that of the upward integration.

What is claimed is:

1. In a system for the transmission of ground vibrations to an ignition device of the type having a sensor for picking up mechanical vibrations and producing output signals corresponding in frequency and amplitude to that of the vibrations, the improvement comprising means disposed between the sensor and the ignition device comprising a frequency filter and a timing circuit for permitting the feeding of the output signal of the frequency filter to the ignition device only after the mechanical vibrations producing the output signal of the frequency filter have acted on the sensor for a predetermined, variable period of time.

2. The system according to claim 1, characterized in that the timing circuit includes means for counting from the first signal produced from the sensed mechanical vibrations picked up to activate the timing circuit with a delay to permit the feeding of the output signal to the ignition device.

3. A system according to claim 1 or claim 2, wherein the means disposed between the sensor and the ignition device further comprises an amplitude filter connected in series before the timing circuit for passing signals above a selectable minimum amplitude and below a selectable maximum amplitude level.

4. The system according to claim 1, wherein the timing circuit comprises a time meter.

5. The system according to claim 1, wherein the timing circuit comprises a time integrator.

6. The system according to claim 1, wherein the frequency filter is connected in series with and before the timing circuit.

* * * * *